US012203400B2

(12) United States Patent
Lamminger et al.

(10) Patent No.: US 12,203,400 B2
(45) Date of Patent: Jan. 21, 2025

(54) METHOD FOR MONITORING REGENERATION OF A PARTICULATE FILTER IN THE EXHAUST GAS SYSTEM OF AN INTERNAL COMBUSTION ENGINE

(71) Applicant: Volkswagen Aktiengesellschaft, Wolfsburg (DE)

(72) Inventors: Lea Maria Lamminger, Braunschweig (DE); Dimitri Illarionov, Neuburg an der Donau (DE); Lars Stratmann, Brome (DE); Christian Steinbrecher, Wismar (DE)

(73) Assignee: Volkswagen Aktiengesellschaft, Wolfsburg (DE)

( * ) Notice: Subject to any disclaimer, the term of this patent is extended or adjusted under 35 U.S.C. 154(b) by 0 days.

(21) Appl. No.: 18/739,208

(22) Filed: Jun. 10, 2024

(65) Prior Publication Data

US 2024/0410308 A1 Dec. 12, 2024

(30) Foreign Application Priority Data

Jun. 12, 2023 (DE) ..... 10 2023 115 282.3

(51) Int. Cl.
*F01N 11/00* (2006.01)
*F01N 3/023* (2006.01)
(Continued)

(52) U.S. Cl.
CPC ..... *F01N 11/00* (2013.01); *F01N 3/023* (2013.01); *F01N 3/035* (2013.01); *F01N 3/101* (2013.01);
(Continued)

(58) Field of Classification Search
CPC ..... F01N 11/00; F01N 11/002; F01N 3/023; F01N 3/035; F01N 3/101; F01N 9/002;
(Continued)

(56) References Cited

U.S. PATENT DOCUMENTS 8,966,882 B2 3/2015 Tylutki et al.
10,156,175 B1 * 12/2018 Hattar ..... F01N 9/002
(Continued)

FOREIGN PATENT DOCUMENTS

DE 60025636 T2 11/2006
DE 102011077097 A1 12/2012
(Continued)

*Primary Examiner* — Ngoc T Nguyen
(74) *Attorney, Agent, or Firm* — Muncy, Geissler, Olds & Lowe, P.C.

(57) ABSTRACT

Regeneration monitoring of a particulate filter in an exhaust gas system of an internal combustion engine of a motor vehicle. Different soot loading stages for the particulate filter are defined. A soot loading of the particulate filter is determined by use of a soot loading model. A soot loading of the particulate filter via a differential pressure measurement across the particulate filter is determined. A regeneration of the particulate filter is initiated when a certain soot loading stage of the particulate filter is reached. A soot discharge from the particulate filter is compared, expected via the soot loading model, to a soot discharge from the particulate filter that is determined via a differential pressure measurement. An error message is outputted when a regeneration stage of the particulate filter, determined by the soot loading model, does not correlate with a regeneration stage that is determined via the differential pressure measurement.

15 Claims, 5 Drawing Sheets

(51) Int. Cl.
*F01N 3/035* (2006.01)
*F01N 3/10* (2006.01)
*F01N 9/00* (2006.01)

(52) U.S. Cl.
CPC ..... *F01N 9/005* (2013.01); *F01N 2550/04* (2013.01); *F01N 2560/08* (2013.01)

(58) Field of Classification Search
CPC ... F01N 9/005; F01N 2550/04; F01N 2560/08
See application file for complete search history.

(56) References Cited

U.S. PATENT DOCUMENTS

| | | | | |
|---|---|---|---|---|
| 11,105,285 | B2 | 8/2021 | Nee | |
| 2018/0202342 | A1 * | 7/2018 | Pannuzzo | F01N 3/023 |
| 2020/0355107 | A1 * | 11/2020 | Wagner | F01N 3/021 |
| 2022/0090527 | A1 | 3/2022 | Turnbull et al. | |

FOREIGN PATENT DOCUMENTS

| | | | | |
|---|---|---|---|---|
| DE | 102013217622 | A1 | 3/2014 | |
| DE | 102014201589 | B3 * | 5/2015 | F01N 11/00 |
| DE | 102018112263 | A1 | 11/2019 | |
| DE | 102020103894 | A1 | 8/2021 | |
| DE | 102021100357 | A1 * | 7/2022 | |
| EP | 3879085 | A1 | 9/2021 | |
| WO | WO-2021170420 | A1 * | 9/2021 | F01N 11/00 |

* cited by examiner

METHOD FOR MONITORING REGENERATION OF A PARTICULATE FILTER IN THE EXHAUST GAS SYSTEM OF AN INTERNAL COMBUSTION ENGINE

This nonprovisional application claims priority under 35 U.S.C. § 119 (a) to German Patent Application No. 10 2023 115 282.3, which was filed in Germany on Jun. 12, 2023, and which is herein incorporated by reference.

BACKGROUND OF THE INVENTION

Field of the Invention

The invention relates to a method for monitoring regeneration of a particulate filter in the exhaust gas system of a spark ignition internal combustion engine for excessively frequent regeneration operations, a control unit for controlling the regeneration of the particulate filter, and an internal combustion engine with an exhaust gas system and a control unit for carrying out such a method according to the preamble of the respective independent claims.

Description of the Background Art

The increasing stringency of exhaust emission regulations has placed high demands on automotive manufacturers, which are addressed by suitable measures to reduce uncontrolled engine emissions and appropriate exhaust aftertreatment. The EU6 legislation prescribes a particle count limit for gasoline engines, which in many cases requires use of a gasoline engine particulate filter. Such soot particles arise in particular after a cold start of the internal combustion engine due to incomplete combustion, in combination with an overstoichiometric combustion air ratio after the cold start, cold cylinder walls, and the heterogeneous mixture distribution in the combustion chambers of the internal combustion engine. In contrast to the loading of a diesel particulate filter, the soot loading of a gasoline engine particulate filter takes place essentially as a function of the combustion chamber temperature, and decreases with increasing combustion chamber temperature. Thus, the cold start phase plays a crucial role in compliance with the regulatory particulate limits, with regard to the particle mass as well as the particle count. At cold outside temperatures, in particular at ambient temperatures below 0° C., particulate emissions are particularly high in a gasoline engine due to the low degree of mixture homogenization and evaporation of the fuel, as well as the starting enrichment. In addition, a cold start with an understoichiometric, rich combustion air ratio results in higher emissions of carbon monoxide (CO) and unburned hydrocarbons (HC), since conversion to carbon dioxide and water vapor is not yet possible due to the cold catalytic converter. During driving operation, for motor vehicles with a gasoline engine particulate filter, this gasoline engine particulate filter then becomes further loaded with soot. This gasoline engine particulate filter must be continuously or periodically regenerated to prevent excessive exhaust back pressure. The increase in exhaust back pressure may result in increased fuel consumption by the internal combustion engine, power loss, and impaired running smoothness, even misfiring. Carrying out thermal oxidation of the soot, retained in the gasoline engine particulate filter, with oxygen requires a sufficiently high temperature level together with the simultaneous presence of oxygen in the exhaust gas system of the gasoline engine. Since current gasoline engines are normally operated with a stoichiometric combustion air ratio ($\lambda=1$) without excess oxygen, additional measures are necessary. Examples of such measures include increasing the temperature by adjusting the ignition angle, temporarily adjusting the gasoline engine to lean conditions, blowing secondary air into the exhaust gas system, or a combination of these measures. Thus far, adjustment of the ignition angle in the retarded direction in combination with an adjustment of the gasoline engine to lean has been preferred, since this method does not require additional components, and is able to deliver a sufficient quantity of oxygen in most operating points of the gasoline engine. Furthermore, with the introduction of new, more stringent exhaust emission standards, there may be a requirement for continuous monitoring of the proper functioning of the exhaust aftertreatment component within the scope of on-board monitoring, using appropriate sensors in the exhaust gas system.

A motor vehicle is known from DE 10 2013 217 622 A1, which corresponds to US 2014/0069081, and which includes an internal combustion engine, an exhaust gas system having a particulate filter that retains soot particles from the exhaust gas stream of the internal combustion engine, a sensor, and a controller. The sensor measures an instantaneous differential pressure across the particulate filter. The controller carries out a process to selectively activate or deactivate performance of an efficiency diagnosis of the particulate filter as a function of a learned differential pressure offset value. The controller may also compare the differential pressure to a calibrated threshold and carry out a control action when the differential pressure is in an allowable range of the threshold.

DE 10 2020 103 894 A1, which is incorporated herein by reference, describes a method for monitoring the regeneration of a particulate filter situated in an exhaust gas system of a gasoline engine. The method comprises the following steps: determining in which regeneration stage, of a defined number of regeneration stages, the particulate filter is being regenerated or was last regenerated; detecting a measure for at least one first test criterion that is characteristic of a change in the loading of the particulate filter; and/or checking whether the first test criterion is met, and changing to a higher regeneration stage if the first test criterion is not met, and changing to a lower regeneration stage or maintaining the present regeneration stage if the first test criterion is met.

A method for diagnosing a particulate filter in the exhaust duct of a combustion engine is known from DE 10 2011 077 097 A1, wherein a particulate filter loading, determined as soot loading of the particulate filter, is predicted based on differential pressure measurements and/or a soot loading model, using a particle sensor. Based on the diagnostic result, a regeneration operation of the particulate filter is initiated. It is provided that a validation of the diagnostic result for the particulate filter with regard to its functionality is carried out as a function of the particulate filter loading and an exhaust gas volume flow in the exhaust duct or a gradient of the exhaust gas volume flow, and based on this validation, the particulate filter is classified as functioning or defective, or the diagnostic result for the particulate filter is classified as unusable.

SUMMARY OF THE INVENTION

It is therefore an object of the invention to monitor regeneration of a particulate filter in the exhaust gas system of an internal combustion engine, and in particular to avoid frequent regeneration cycles, which are associated with worsening of the uncontrolled emissions of the internal combustion engine and/or worsening of the tailpipe emissions of the internal combustion engine.

The object is achieved, in an example, by a method for monitoring regeneration of a particulate filter in the exhaust gas system of an internal combustion engine. The internal combustion engine has at least one combustion chamber, preferably a plurality of combustion chambers, wherein a fuel injector for injecting a fuel into the combustion chamber and/or a fuel injection valve for injecting a fuel into the intake tract of the internal combustion engine is situated at each combustion chamber, and a spark plug for igniting a combustible fuel-air mixture is situated at the combustion chamber. The method comprises the following steps: defining different soot loading stages for the particulate filter; determining a soot loading of the particulate filter by use of a soot loading model and assigning the determined soot loading to one of the defined soot loading stages; determining a soot loading of the particulate filter via a differential pressure measurement across the particulate filter and assigning the determined soot loading to one of the defined soot loading stages; initiating a regeneration of the particulate filter when a certain soot loading stage of the particulate filter, determined via the differential pressure measurement, is reached; and/or comparing the stage determined via the soot loading model to the soot loading stage determined via the differential pressure, wherein an error message is output when a regeneration stage of the particulate filter, determined by the soot loading model, does not correlate with a regeneration stage that is determined via the differential pressure measurement.

The method according to the invention makes it possible to monitor the regeneration of a particulate filter, and in particular to monitor that an excessively frequent regeneration of the particulate filter and/or excessively high uncontrolled particulate emissions of the internal combustion engine result(s) in frequent regeneration operations of the particulate filter, which due to the engine-internal measures that initiate or accompany the regeneration lead to an increase in the tailpipe emissions.

In an example, it is provided that when a regeneration is initiated and carried out due to an exceedance of a threshold value for the differential pressure, with the soot loading stage that is associated with the threshold value, it is checked whether the soot loading stage determined using the soot loading model correlates with the decrease in the loading stage determined via the differential pressure measurement. The maximum achieved regeneration stage of the soot loading model is preferably over the complete regeneration operation. If there is a sufficient correlation between the soot loading stage determined via the differential pressure measurement and the soot loading stage determined by the soot loading model, it may be assumed that the regeneration of the particulate filter, triggered by the differential pressure sensor, is plausible. If this is not the case, it may be assumed that the internal combustion engine is emitting more soot than expected, or more than it should emit when properly functioning. The particulate filter may thus be monitored for excessively frequent regenerations.

An error can be recognized when an increase in the soot loading stages of the particulate filter measured determined via the differential pressure measurement does not correlate with an increase in the soot loading stages determined via the soot loading model. When the internal combustion engine is operating properly, the increase in the differential pressure and the soot loading stages of the particulate filter determined via the differential pressure measurement should correlate with an increase in the soot loading stages of the particulate filter determined via the soot loading model. If this is not the case, in particular if an increase in the soot loading stages determined via the differential pressure measurement takes place much more quickly than the soot loading stages determined via the soot loading model, it is to be assumed that the internal combustion engine is emitting more soot particles than would be expected during proper operation, and therefore more frequent regenerations of the particulate filter are necessary. Such an error may be recognized by the method in an operationally reliable manner in order to prevent further damage to the particulate filter and/or to avoid an unallowable increase in the emissions.

A differential pressure range of the differential pressure measured across the particulate filter is assigned to each of the soot loading stages in the soot loading model. A particularly simple assignment of the soot loading stages of the soot loading model to the soot loading of the particulate filter measured via the differential pressure is thus possible.

The soot loading model can include at least three soot loading stages, in a first stage no regeneration of the particulate filter being necessary, in a second stage a simple regeneration of the particulate filter taking place, and in a third soot loading stage a controlled regeneration of the particulate filter taking place. Excessively frequent regenerations of the particulate filter may be avoided by use of such a phased model, since a mandatory regeneration of the particulate filter using engine-internal measures takes place only when the loading of the particulate filter has reached a certain soot loading stage.

The soot loading model can include a further soot loading stage in which regeneration during driving operation is no longer allowable, and the driver is prompted to have the particulate filter checked in a repair shop. If the particulate filter reaches such a critical soot loading stage, in which during regeneration there is a risk of uncontrolled soot burn-off and/or heat input into the particulate filter, which would result in permanent thermal damage to the particulate filter, the driver is prompted to take the motor vehicle to a repair shop and have an external regeneration of the particulate filter performed in order to avoid permanent damage to the particulate filter.

The soot loading model can include a further soot loading stage in which replacement of the particulate filter is required. If the loading of the particulate filter exceeds the loading described in the preceding sections, and/or if the initiation of a regeneration operation no longer results in a decrease in the differential pressure, the particulate filter must be replaced. Such a condition may be recognized by the described method, so that the driver is prompted to visit a repair shop to have the particulate filter replaced in order to avoid increased tailpipe emissions, in particular increased particulate emissions and/or damage to the internal combustion engine, in particular due to excessively high exhaust back pressure.

During regeneration, information may be output to the driver beginning at a certain soot loading stage of the particulate filter. In the process, regenerations take place in a lower regeneration stage, unnoticeable to the driver. A regeneration in a higher regeneration stage, which generally lasts longer and is noticeable to the driver due to the initiation of engine-internal measures, is indicated by a warning message, so that the driver may associate the engine-internal measures with the regeneration of the particulate filter. In particular, the situation may thus be prevented that the driver inadvertently switches off the internal combustion engine during a regeneration operation, and an incomplete regeneration of the particulate filter is thus carried out.

Upon reaching a certain soot loading stage, engine-internal measures for initiating a regeneration and/or for assisting the regeneration of the particulate filter can be initiated. When the vehicle is routinely driven under high partial load or full load, for example when driving on expressways, the normal operation of the internal combustion engine may be sufficient to provide operating conditions for the particulate filter in which regeneration of the particulate filter takes place by oxidation of the soot particles retained in the particulate filter. However, if the particulate filter reaches a higher loading stage, and the operating conditions, in particular the regeneration temperature of the particulate filter, are not reached during driving operation, regeneration may be initiated by increasing the exhaust gas temperature via engine-internal measures. In this way, regeneration of the particulate filter may be initiated, and soot loading of the particulate filter may be prevented from exceeding a critical level.

A control unit is also provided for carrying out the method described herein, the control unit including a memory unit and a processing unit as well as a computer program code that is stored in the memory unit, and the method being carried out when the computer program code is executed by the processing unit. Such a control unit allows an internal combustion engine and an exhaust aftertreatment system of the internal combustion engine to be controlled in such a way that a method according to the invention for monitoring and regenerating a particulate filter in the exhaust gas system of an internal combustion engine may be carried out.

Provided is also an internal combustion engine that can include at least one combustion chamber, with a fuel injector for injecting fuel into the combustion chamber and a spark plug for igniting a combustible fuel-air mixture being situated at the combustion chamber. At its outlet the internal combustion engine is connected to an exhaust gas system in which a particulate filter is situated. The internal combustion engine is also connected to a control unit, described in the preceding section. In such an internal combustion engine, the emissions may be reduced during the regeneration of the particulate filter, since unnecessary regeneration measures that result in increased emissions may be dispensed with.

A three-way catalytic converter as a first exhaust aftertreatment component can be situated in the exhaust gas system in the flow direction of an exhaust gas stream of the internal combustion engine through the exhaust gas system, and a particulate filter is situated downstream from the three-way catalytic converter. Particularly advantageous exhaust aftertreatment is possible in this way, since after a cold start, the three-way catalytic converter quickly reaches operating temperature due to the position near the engine, and efficient conversion of the limited pollutants in the exhaust gas stream of the internal combustion engine is thus made possible immediately after a cold start of the internal combustion engine. In addition, this arrangement allows the particulate filter to likewise be situated near the engine, thus simplifying heating up of the particulate filter for initiating a regeneration. In this context, a position near the engine is understood to mean a position of an inlet of the exhaust aftertreatment component with an exhaust gas run length of less than 80 cm, preferably less than 60 cm, beginning at an outlet of the internal combustion engine.

A further three-way catalytic converter can be situated downstream from the particulate filter. The catalytic converter volume for the three-way catalytic converters may thus be distributed over two units, as a result of which the first three-way catalytic converter near the engine may be designed with a smaller volume, and thus reaches its light-off temperature more quickly. In addition, the secondary emissions that arise during the oxidation of the soot during the regeneration of the particulate filter may be converted by the second three-way catalytic converter, so that the regeneration results in little or no increase in the tailpipe emissions.

The particulate filter and the further three-way catalytic converter may be designed so that they are combined in a single component as a so-called four-way catalytic converter. For this purpose, the particulate filter has a catalytically active coating, which preferably is applied as a wash-coat to the filter structure of the particulate filter, and which may oxidize the limited pollutants such as unburned hydrocarbons and carbon monoxide, and may reduce nitrogen oxides.

The internal combustion engine can be designed as a spark ignition internal combustion engine according to the Otto principle, which is charged using an exhaust gas turbocharger. The filling in the combustion chambers of the internal combustion engine may be improved by charging the internal combustion engine. This measure, in particular in combination with a fuel injector that can deliver an injection pressure in the range of up to 350 bar, may result in a reduction in the uncontrolled particulate emissions, and thus in the frequency with which a particulate filter must be regenerated.

The various examples of the invention mentioned in the present patent application may advantageously be combined with one another.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
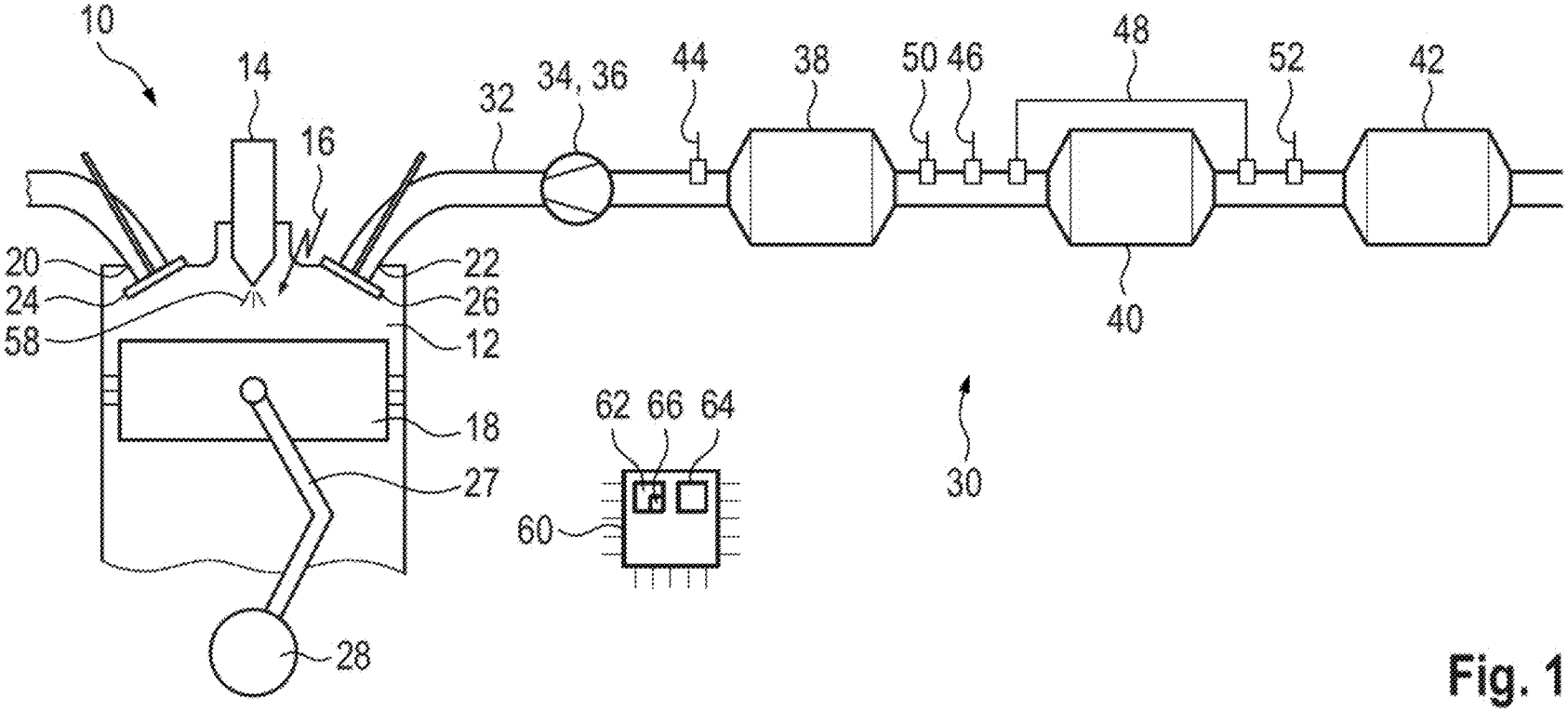
FIG. 1 shows an example of an internal combustion engine with an exhaust gas system and a control unit for carrying out a method according to the invention for monitoring a particulate filter in the exhaust gas system of the internal combustion engine.

FIG. 1 shows a schematic illustration of an internal combustion engine 10. The internal combustion engine 10 is designed as a direct injection gasoline engine. The internal combustion engine 10 has multiple combustion chambers 12. A fuel injector with a fuel injection valve 14 for injecting a fuel 58 into the particular combustion chamber 12, and a spark plug 16 for igniting a fuel-air mixture in the particular combustion chamber 12, are situated at each of the combustion chambers 12. The combustion chamber 12 is delimited by a piston 18 that is displaceable in the axial direction. The oscillating movement of the piston is transferred into a rotary movement of a crankshaft 28 of the internal combustion engine by a connecting rod 27. The internal combustion engine 10 via its inlet 20 is connected to an air supply system, and via its outlet 22 is connected to an exhaust gas system 30. Situated at the combustion chambers 12 are intake valves 24 and exhaust valves 26, via which a fluidic connection from the air supply system to the combustion chambers 12 or from the combustion chambers 12 to the exhaust gas system 30 may be opened or closed. Alternatively or additionally, the internal combustion engine 10 may have one or more fuel injection valves 14 that are situated in an intake tract of the internal combustion engine 10.

The exhaust gas system 30 includes an exhaust duct 32 in which a three-way catalytic converter 38 near the engine as a first exhaust aftertreatment component, a particulate filter 40 downstream from the three-way catalytic converter near the engine, and a second three-way catalytic converter 42 farther downstream are situated in the flow direction of an exhaust gas stream of the internal combustion engine 10, the second three-way catalytic converter 42 preferably being situated in an underbody position of a motor vehicle. In addition, a turbine 36 of an exhaust gas turbocharger 34 may be situated in the exhaust gas system 30. A first lambda sensor 44, in particular a broadband sensor, for detecting the oxygen concentration in the exhaust gas stream is situated in the exhaust gas system, downstream from the outlet 22 of the internal combustion engine 10 and upstream from the first three-way catalytic converter 38. A second lambda sensor 46, in particular a jump sensor, is situated downstream from the first three-way catalytic converter 38 and upstream from the second three-way catalytic converter 42, in particular downstream from the first three-way catalytic converter 38 and upstream from the particulate filter 40. Furthermore, situated in the exhaust gas system 30 is a first temperature sensor 50, downstream from the first three-way catalytic converter 38 and upstream from the particulate filter 40, and a second temperature sensor 52, downstream from the particulate filter 40 and upstream from the second three-way catalytic converter 42. A differential pressure sensor 48 that determines a pressure difference between an inlet to the particulate filter 40 and an outlet from the particulate filter 40 is situated at the particulate filter 40. The pressure difference across the particulate filter 40 is correlated with the particulate loading of the particulate filter 40; when a defined threshold value for the differential pressure is reached, regeneration of the particulate filter 40 is initiated in order to avoid further loading and associated potential damage to the particulate filter 40.

The internal combustion engine 10 is connected to a control unit 60 that includes a memory unit 62 and a processing unit 64. A computer program code 66 is stored in the memory unit 62, and carries out a method according to the invention when the computer program code is executed by the processing unit of the control unit.

Figure 2:
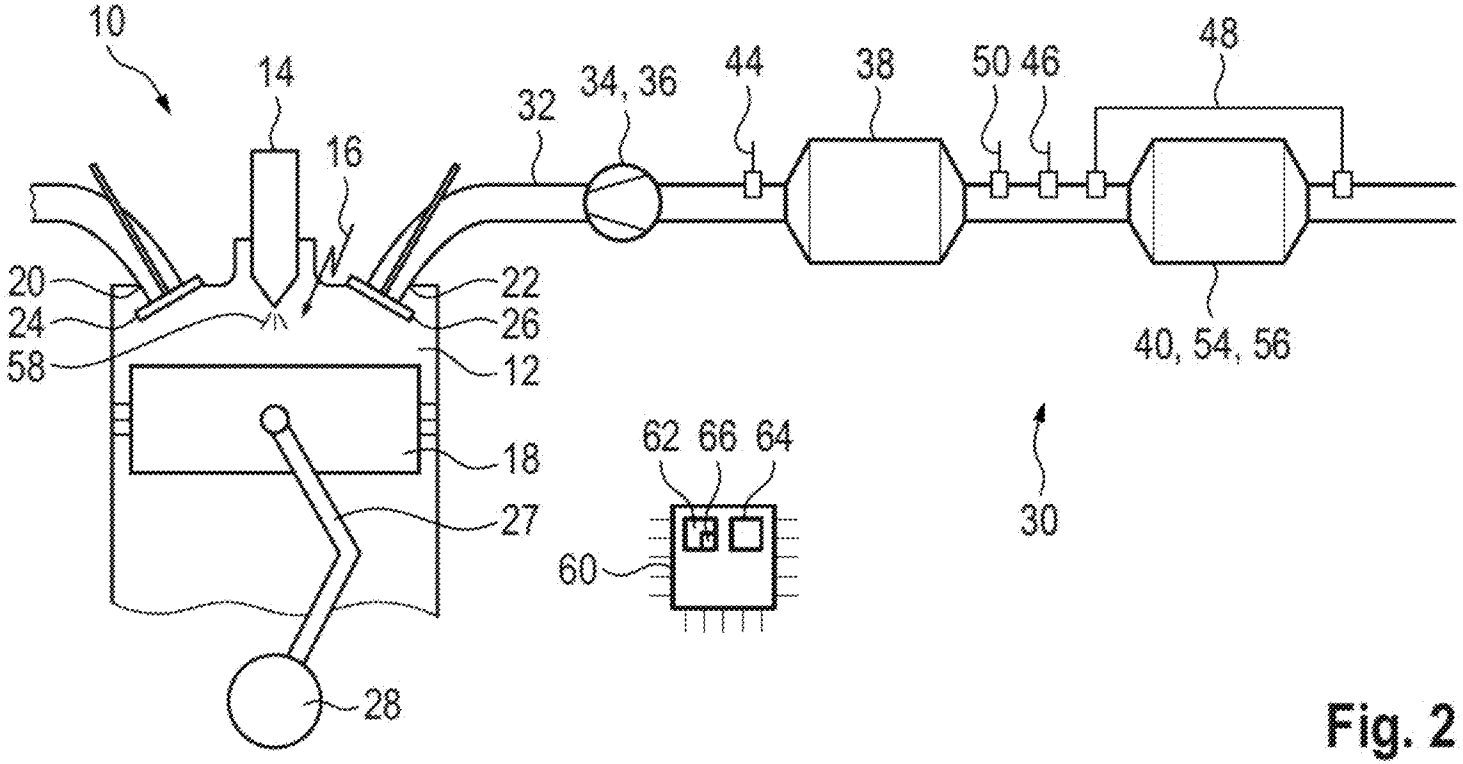
FIG. 2 shows an example of an internal combustion engine for carrying out a method according to the invention for monitoring a particulate filter in the exhaust gas system of the internal combustion engine.

FIG. 2 illustrates an example of an internal combustion engine 10. The internal combustion engine 10 is designed as a direct injection gasoline engine. The internal combustion engine 10 has multiple combustion chambers 12. A fuel injector with a fuel injection valve 14 for injecting a fuel 58 into the particular combustion chamber 12, and a spark plug 16 for igniting a fuel-air mixture in the particular chamber 12, are situated at each of the combustion chambers 12. The combustion chamber 12 is delimited by a piston 18 that is displaceable in the axial direction. The oscillating movement of the piston is transferred into a rotary movement of a crankshaft 28 of the internal combustion engine by a connecting rod 27. The internal combustion engine 10 via its inlet 20 is connected to an air supply system, and via its outlet 22 is connected to an exhaust gas system 30. Situated at the combustion chambers 12 are intake valves 24 and exhaust valves 26, via which a fluidic connection from the air supply system to the combustion chambers 12 or from the combustion chambers 12 to the exhaust gas system 30 may be opened or closed. Alternatively or additionally, the internal combustion engine 10 may have one or more fuel injection valves 14 that are situated in an intake tract of the internal combustion engine 10.

The exhaust gas system 30 includes an exhaust duct 32 in which a three-way catalytic converter 38 near the engine as a first exhaust aftertreatment component, and a particulate filter 40 with a catalytically active coating 54, downstream from the three-way catalytic converter 38 near the engine, are situated in the flow direction of an exhaust stream of the internal combustion engine 10. The particulate filter 40 may in particular be designed as a so-called four-way catalytic converter 56; such a four-way catalytic converter combines the functionality of a three-way catalytic converter 42 and a particulate filter 40 in a single component. The filter substrate of the particulate filter 40 is covered with a washcoat having the functionality of a three-way catalytic converter. In addition, a turbine 36 of an exhaust gas turbocharger 34 may be situated in the exhaust gas system 30. A first lambda sensor 44, in particular a broadband sensor, for detecting the oxygen concentration in the exhaust gas stream is situated in the exhaust gas system, downstream from the outlet 22 of the internal combustion engine 10 and upstream from the first three-way catalytic converter 38. A second lambda sensor 46, in particular a jump sensor, is situated downstream from the first three-way catalytic converter 38 and upstream from the particulate filter 40.

Furthermore, a first temperature sensor 50 is situated in the exhaust gas system 30, downstream from the first three-way catalytic converter 38 and upstream from the particulate filter 40. A differential pressure sensor 48 that determines a pressure difference between an inlet to the particulate filter 40 and an outlet from the particulate filter 40 is situated at the particulate filter 40. The pressure difference across the particulate filter 40 is correlated with the particulate loading of the particulate filter 40; when a defined threshold value for the differential pressure is reached, regeneration of the particulate filter 40 is initiated in order to avoid further loading and associated potential damage to the particulate filter 40.

The internal combustion engine 10 is connected to a control unit 60 that includes a memory unit 62 and a processing unit 64. A computer program code 66 is stored in the memory unit 62, and carries out a method according to the invention when the computer program code is executed by the processing unit of the control unit 60.

Figure 3:
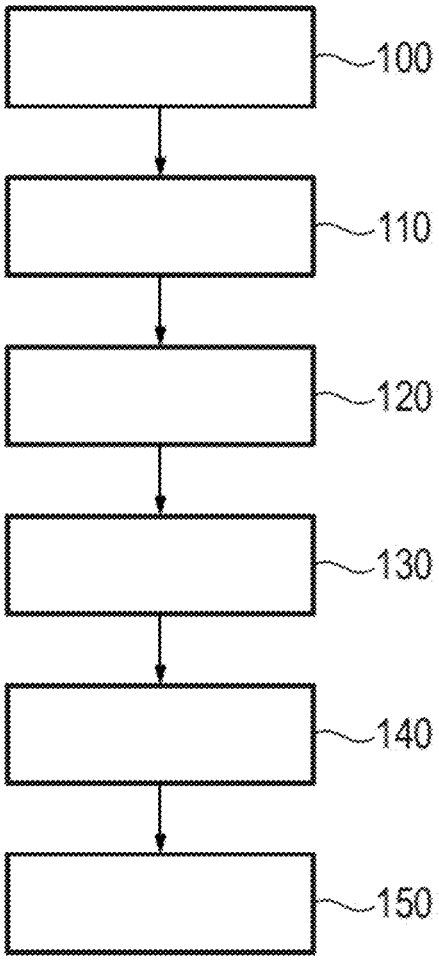
FIG. 3 shows a flow chart for carrying out a method according to the invention for monitoring a particulate filter in the exhaust gas system of an internal combustion engine.

FIG. 3 illustrates a flow chart for carrying out a method according to the invention for monitoring a particulate filter in the exhaust gas system of an internal combustion engine.

Figure 4:
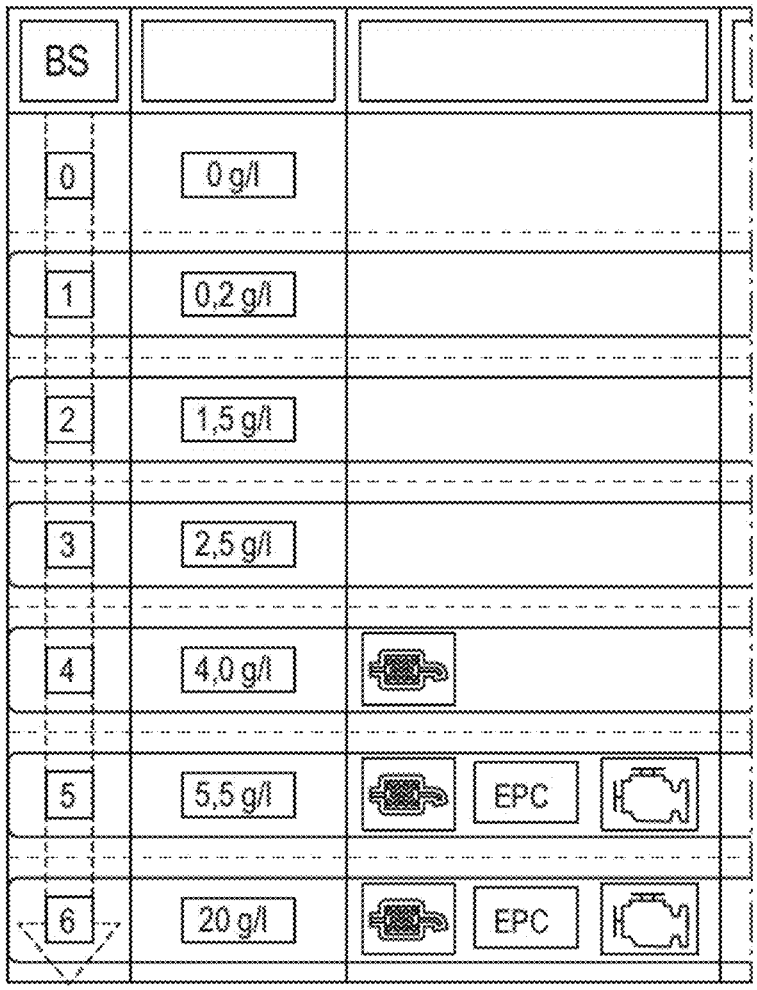
FIG. 4 shows a loading stage model for a particulate filter.

Different soot loading stages for the particulate filter 40 are defined in a method step <100>. Thus, as illustrated in FIG. 4, for example, seven different loading stages may be defined.

A present soot loading of the particulate filter 40 is determined in a method step <110> by a soot loading model that is implemented in the control unit 60. In the same step, the soot loading determined by the soot loading model is assigned to one of the soot loading stages defined in step <100>.

A soot loading of the particulate filter 40 is determined via a differential pressure measurement across the particulate filter 40 in a method step <120>, which may take place in parallel with method step <110> or before or after method step <110>. In the same step, the soot loading determined via the differential pressure measurement is assigned to one of the soot loading stages defined in step <100>.

Regeneration of the particulate filter 40 is initiated in a method step <130> when a certain soot loading stage of the particulate filter 40, determined via the differential pressure measurement, is reached.

The soot loading stage determined via the soot loading model is compared to the soot loading stage of the particulate filter 40 determined via the differential pressure measurement in a method step <140>.

An error message is output in a method step <150> when the regeneration stage of the particulate filter 40, determined by the soot loading model, does not correlate with the regeneration stage that is determined via the differential pressure measurement.

FIG. 4 illustrates a table for a loading stage model for a particulate filter 40. In a loading stage 0 the particulate filter 40 has no soot loading, so that measures for regenerating the particulate filter 40 are not necessary. In a loading stage 1 the particulate filter 40 has slight soot loading, for example a soot loading of 0.1 g/L to 0.5 g/L particulate filter volume. Regeneration of the particulate filter 40 is possible in the first loading stage, but no active measures for starting a regeneration of the particulate filter 40 are initiated. In a loading stage 2 the particulate filter has a loading that is above the loading of the first loading stage 1, for example 1 g/L to 2 g/L particulate filter volume. Regeneration is possible in the second loading stage 2, but in this loading stage generally no engine-internal heating measures are undertaken to initiate a regeneration of the particulate filter 40. Loading stage 3 represents a loading state of the particulate filter 40 in which regeneration of the particulate filter 40 is desirable in order to avoid a further increase in the exhaust back pressure and associated adverse consequences such as an increase in the fuel consumption or misfires of the internal combustion engine 10. In loading stage 4, regeneration of the particulate filter 40 is absolutely necessary in order to maintain the effectiveness of the exhaust aftertreatment and avoid worsening of emissions from the internal combustion engine 10. In loading stage 5, regeneration of the particulate filter 40 during a driving operation of the motor vehicle is no longer possible, or at least is not possible without the risk of permanent damage to the particulate filter 40, in particular thermal damage due to excessive heat input during the oxidation of the soot retained in the particulate filter 40. If the regeneration of the particulate filter 40 is disturbed or the internal combustion engine emits more particulate than expected, when a sixth loading stage is reached the driver is prompted to visit a repair shop and have the particulate filter 40 and/or components of the internal combustion engine 10, in particular the fuel injectors 14 and/or the spark plugs 16, replaced.

Figure 5:
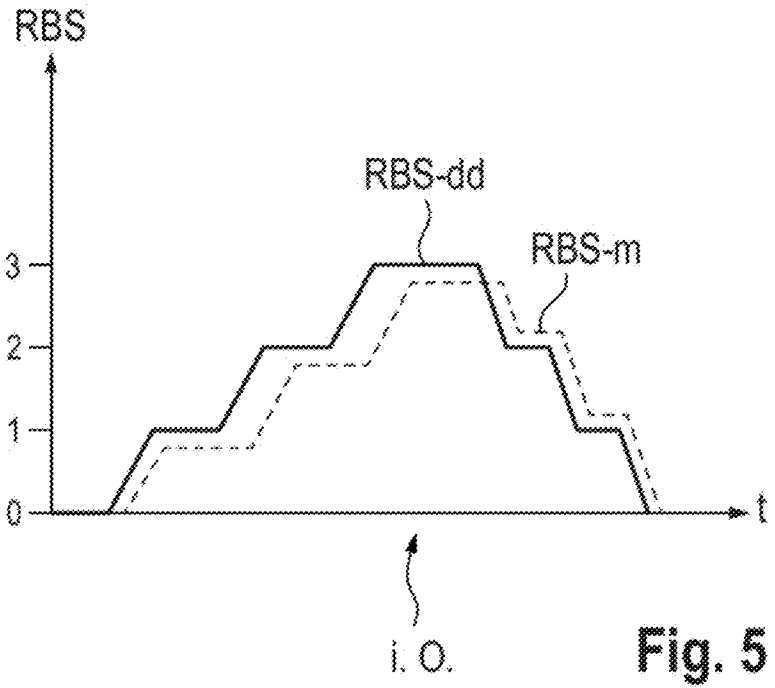
FIG. 5 shows a regeneration diagram for regenerating a particulate filter during proper regeneration of the particulate filter.

FIG. 5 illustrates a regeneration model for the particulate filter 40. Regeneration of the particulate filter 40 is monitored in order to recognize errors in the regeneration of the particulate filter 40 and avoid excessively frequent initiation of a regeneration operation. As soon as a certain soot loading stage RBS_dd of the particulate filter 40*e* is reached via measurement of the differential pressure DD across the particulate filter 40, a modeled soot mass within a modeled soot loading stage m of the soot loading model is initialized. The modeled soot mass may either increase or decrease, depending on the physical input. When a regeneration of the particulate filter 40 is initiated, it is to be assumed that the modeled soot loading stage RBS_m likewise decreases, and correlates with the decrease of the soot loading stage RBS_dd determined via the differential pressure. When an appropriate portion of the modeled soot mass is removed, theoretically the actual soot mass has also been reduced to a comparable quantity, resulting in a lower modeled regeneration level. In the time period in which a certain regeneration of the particulate filter 40 is triggered and successfully carried out via the differential pressure sensor 48, the soot loading model should have likewise recognized a certain regeneration stage or soot loading stage, and thus a certain loading of the particulate filter 40. Such a pattern is assumed when there is a sufficient correlation between the decreases of the soot loading stage RBS_dd determined via the differential pressure measurement and the soot loading stage RBS_m determined by the soot loading model.

Figure 6:
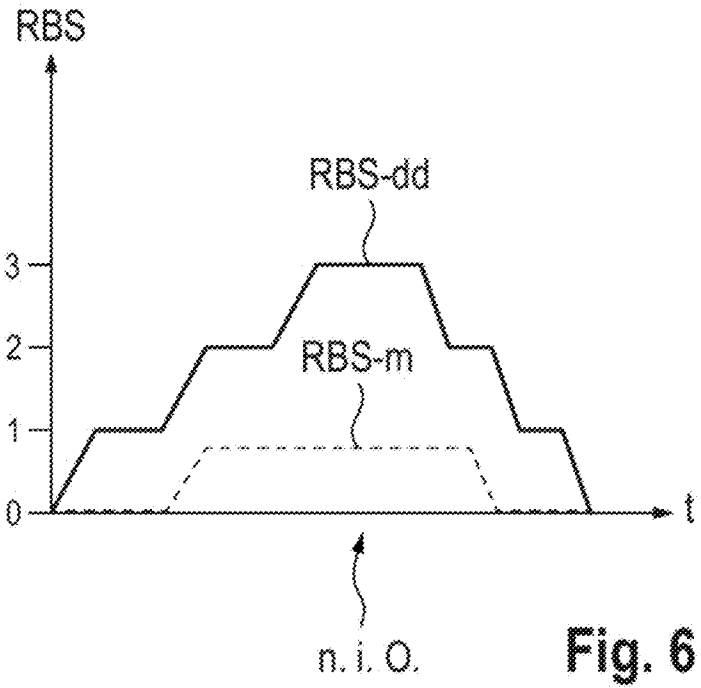
FIG. 6 shows a regeneration diagram for regenerating the particulate filter during an excessively frequent regeneration of the particulate filter due to increased particulate emissions from the internal combustion engine.

If this is not the case, it may be assumed that the internal combustion engine 10 is emitting more soot than expected when the internal combustion engine 10 is properly functioning. Such a case is illustrated in FIG. 6. The monitoring may be focused on soot loading stages in which an adverse environmental impact results from engine-related measures. Via defined conditions it is ruled out that non-functional regeneration is indicated. Separate monitoring is available for this purpose. The maximum regeneration stage reached or a minimum soot loading stage RBS_m of the soot loading model over the entire monitoring period is determined. A comparison of the request for the soot loading stage RBS_dd reached via the differential pressure measurement and the minimum soot loading stage RBS_m of the soot loading model reached during the regeneration takes place only when the request by the differential pressure sensor 48 for regeneration of the particulate filter 40 has successfully taken place.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for monitoring regeneration of a particulate filter in an exhaust gas system of an internal combustion engine, the internal combustion engine comprising at least one combustion chamber at which a spark plug for igniting a combustible fuel-air mixture is arranged, the internal combustion engine further comprising a fuel injection valve for feeding a fuel into an intake tract of the internal combustion engine and/or into the combustion chamber of the internal combustion engine, the method comprising:

defining different soot loading stages for the particulate filter;

determining a soot loading of the particulate filter by use of a soot loading model and assigning the soot loading to one of a defined soot loading stages;

determining a soot loading of the particulate filter via a differential pressure measurement across the particulate filter and assigning the determined soot loading to one of the defined soot loading stages;

initiating a regeneration of the particulate filter when a certain soot loading stage of the particulate filter, determined via the differential pressure measurement, is reached;

comparing the soot loading stage determined via the soot loading model to the soot loading stage of the particulate filter determined via the differential pressure measurement; and outputting an error message when a regeneration stage of the particulate filter, determined by the soot loading model, does not correlate with a regeneration stage that is determined via the differential pressure measurement.

2. The method according to claim 1, wherein when the regeneration is initiated and carried out due to an exceedance of a threshold value for the differential pressure, with the soot loading stage that is associated with the threshold value, and checking whether the soot loading stage determined using the soot loading model correlates with the decrease in the soot loading stage determined via the differential pressure measurement.

3. The method according to claim 1, wherein an error is recognized when an increase in the soot loading stages of the particulate filter measured, determined by the differential pressure measurement, does not correlate with an increase in the soot loading stages determined via the soot loading model.

4. The method according to claim 1, wherein a differential pressure range of the differential pressure measured across the particulate filter is associated with each soot loading stage in the soot loading model.

5. The method according to claim 1, wherein the soot loading model includes at least three soot loading stages for the particulate filter, in a first stage no regeneration of the particulate filter being necessary, in a second stage a simple regeneration of the particulate filter taking place, and in a third stage a controlled regeneration of the particulate filter taking place.

6. The method according to claim 5, wherein the soot loading model includes a further soot loading stage in which regeneration during driving operation is no longer allowable, and the driver is prompted to have the particulate filter checked in a repair shop.

7. The method according to claim 6, wherein the soot loading model includes a further soot loading stage in which replacement of the particulate filter is required.

8. The method according to claim 1, wherein during regeneration, information is output to the driver beginning at a certain soot loading stage.

9. The method according to claim 1, wherein upon reaching a certain soot loading stage, engine-internal measures for initiating a regeneration and/or for assisting the regeneration of the particulate filter are initiated.

10. A control unit to perform the method according to claim 1, the control unit comprising:

a memory;

a processor; and a computer program code that is stored in the memory unit, wherein the method is carried out when the computer program code is executed by the processing unit.

11. An internal combustion engine comprising:

at least one combustion chamber;

a fuel injection valve to feed a fuel into an intake tract of the internal combustion engine and/or into the combustion chamber of the internal combustion engine, a spark plug for igniting a combustible fuel-air mixture being arranged at the combustion chamber; and an outlet being connected to an exhaust gas system in which a particulate filter is arranged, and being connected to the control unit according to claim 10.

12. The internal combustion engine according to claim 11, wherein a three-way catalytic converter as a first exhaust aftertreatment component is situated in the exhaust gas system in a flow direction of an exhaust gas stream of the internal combustion engine through the exhaust gas system, and the particulate filter is arranged downstream from the three-way catalytic converter.

13. The internal combustion engine according to claim 12, wherein a further three-way catalytic converter is arranged downstream from the particulate filter.

14. The internal combustion engine according to claim 11, wherein the particulate filter has a catalytically active coating.

15. The internal combustion engine according to claim 11, wherein the internal combustion engine is designed as a spark ignition internal combustion engine that is charged using an exhaust gas turbocharger.

* * * * *